United States Patent [19]

Ascoli

[11] 4,115,920

[45] Sep. 26, 1978

[54] DRY SHAVER WITH PRIMARY AND SECONDARY MODES OF OSCILLATION

[75] Inventor: Enzo Ascoli, Lausanne, Switzerland

[73] Assignee: The Gillette Company, Boston, Mass.

[21] Appl. No.: 791,648

[22] Filed: Apr. 27, 1977

[30] Foreign Application Priority Data

May 13, 1976 [GB] United Kingdom ..... 19706/76

[51] Int. Cl.[2] ..... B26B 19/26; B26B 19/02

[52] U.S. Cl. ..... 30/43.3; 30/43.92

[58] Field of Search ..... 30/42, 43.3, 43.7, 43.91, 30/43.8, 43.92

[56] References Cited

U.S. PATENT DOCUMENTS

| | | | |
|---|---|---|---|
| 2,260,114 | 10/1941 | Hammond | 30/43.8 |
| 2,339,677 | 1/1944 | Burns | 30/43.91 |
| 2,342,467 | 2/1944 | Hagopian | 30/43.3 |
| 2,830,364 | 4/1958 | Barnard | 30/43.91 |
| 2,920,387 | 1/1960 | Marescalchi | 30/43.91 |
| 3,074,161 | 1/1963 | Liska | 30/43.92 |
| 3,156,045 | 11/1964 | Godefroy | 30/43.3 |
| 3,319,333 | 5/1967 | Futterer | 30/43.92 |
| 3,962,783 | 6/1976 | Retemma | 30/43.92 X |
| 4,030,573 | 6/1977 | Buzzi | 30/42 |

*Primary Examiner*—Gary L. Smith

*Attorney, Agent, or Firm*—Richard A. Wise; Donald E. Mahoney

[57] ABSTRACT

An electric dry shaver in the form of a generally rectangular parallelepiped and comprising a flexible part-cylindrical curved cutting foil extending along one end face and inclined towards the front face of said parallelepiped. A cutter body has cutter blades having curved cutting edges and extending in planes perpendicular to the foil cylinder axis. A spring acts on said cutter body to urge said cutting edges into engagement with said foil. A rotary electric drive motor has its axis of rotation extending between said opposite end faces. A cutter support member carries said cutter body and is mounted to a shaver body member by a pair of spaced parallel leaf springs, each said leaf spring lying when unflexed in a plane parallel to said opposite side faces. The electric motor has a rotary output member adapted to drive said cutter support member in generally longitudinal oscillation with flexing of said leaf springs. Said cutter support member is coupled to said cutter body by a coupling head working in a bore so as to drive said cutter body both in a primary mode of oscillation substantially linearly and axially of said foil to effect a shaving action and in a secondary mode of oscillation transverse to the foil cylinder axis and in a plane inclined towards said front face to cause said foil to oscillate in sympathy with said second mode of oscillation of said cutter body.

10 Claims, 8 Drawing Figures

DRY SHAVER WITH PRIMARY AND SECONDARY MODES OF OSCILLATION

BACKGROUND OF THE INVENTION

This invention relates to an electric dry shaver of the type having a perforated cutting foil engaged by the cutting edges of cutter blades of an oscillatory cutter.

With shavers of the foregoing type the foil is normally flexible and is retained in a part-cylindrical curved shape in engagement with the cutting edges of the cutter blades. In one form the cutter blades have curved cutting edges and extend in planes perpendicular to the foil cylinder axis, the cutter being driven in linear reciprocation axially of said foil, and being guided in a manner chosen to minimize any movement other than along the linear reciprocation axis.

PRIOR ART

French Pat. No. 1,174,958 describes an electric dry shaver including a first cam that positively drives a body, and other parts including a shaving foil, in linear oscillation in a plane as constrained by leaf springs. A second cam simultaneously drives a driver and a cutter in linear oscillation in the perpendicular plane as constrained by another pair of leaf springs. Thus the foil and the cutter are both positively and directly driven in a secondary oscillation perpendicular to a primary cutting oscillation and at the same frequency.

Swiss Pat. No. 354,693 describes a cutter driven only in a linear oscillation. The foil is positively and directly driven in a secondary oscillation transverse to the primary oscillation.

An object of this invention is to improve the cutting action and drive means of a dry shaver of the type concerned.

SUMMARY OF THE INVENTION

According to the present invention there is provided an electric dry shaver comprising a flexible part-cylindrical curved cutting foil, a cutter body having a plurality of cutter blades with cutting edges urged into engagement with said foil, drive means adapted to drive said cutter body both in a primary mode of oscillation parallel to said foil to effect a shaving action and in a secondary mode of oscillation at an angle to said foil to cause said foil to oscillate in sympathy with said secondary mode of oscillation of said cutter body.

In a preferred form the invention provides an electric dry shaver in the form of a generally rectangular parallelepiped and comprising a flexible part-cylindrical curved cutting foil extending along one end face of said parallelepiped and inclined towards the front face of said parallelepiped, a cutter body having a plurality of cutter blades having curved cutting edges and extending in planes perpendicular to the foil cylinder axis, a spring acting on said cutter body to urge said cutting edges into engagement with said foil, drive means including a rotary electric drive motor having its axis of rotation extending between said opposite end faces generally midway between said front and back faces and generally midway between the opposite side faces of the shaver, a cutter support member carrying said cutter body and mounted to a shaver body member by a pair of spaced parallel leaf springs, each said leaf spring lying when unflexed in a plane parallel to said opposite side faces, said electric motor having a rotary output member adapted to drive said cutter support member in generally longitudinal oscillation with flexing of said leaf springs, and means coupling said cutter support member to said cutter body to drive said cutter body both in a primary mode of oscillation substantially linearly and axially of said foil to effect a shaving action and in a secondary mode of oscillation transverse to the foil cylinder axis and in a plane inclined towards said front face to cause said foil to oscillate in sympathy with said second mode of oscillation of said cutter body.

BRIEF DESCRIPTION OF DRAWINGS

Embodiments of the invention will now be described, by way of example, with reference to the accompanying drawings, in which.

DESCRIPTION OF PREFERRED EMBODIMENTS

Figure 1:
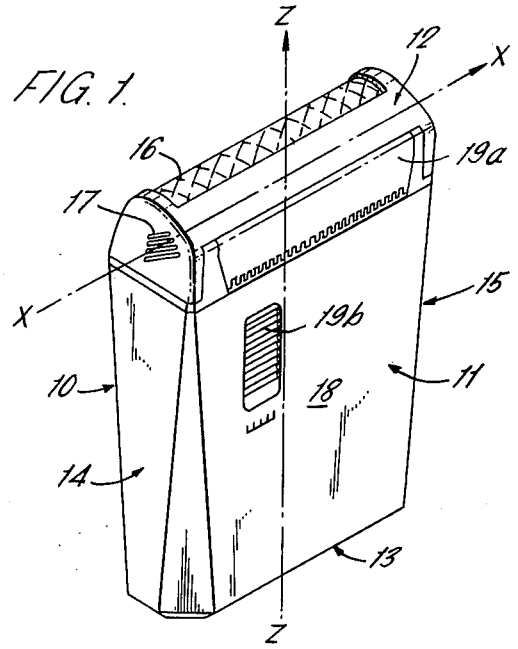
FIG. 1 is a perspective external view of an electric dry shaver according to the invention.
Figure 4:
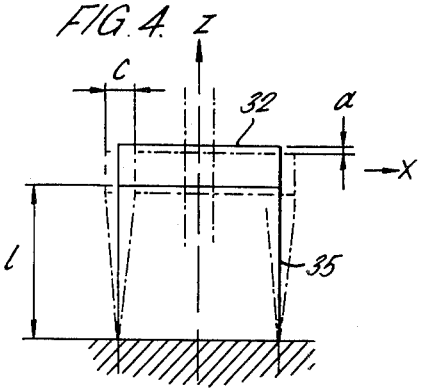
FIG. 4 is a diagrammatic view illustrating movement of a leaf spring cutter mounting of the embodiment of FIGS. 2 and 3.
Figure 5:
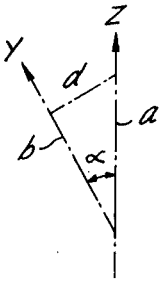
FIG. 5 is a vector diagram relating to the transverse cutting movement.
Figure 8:
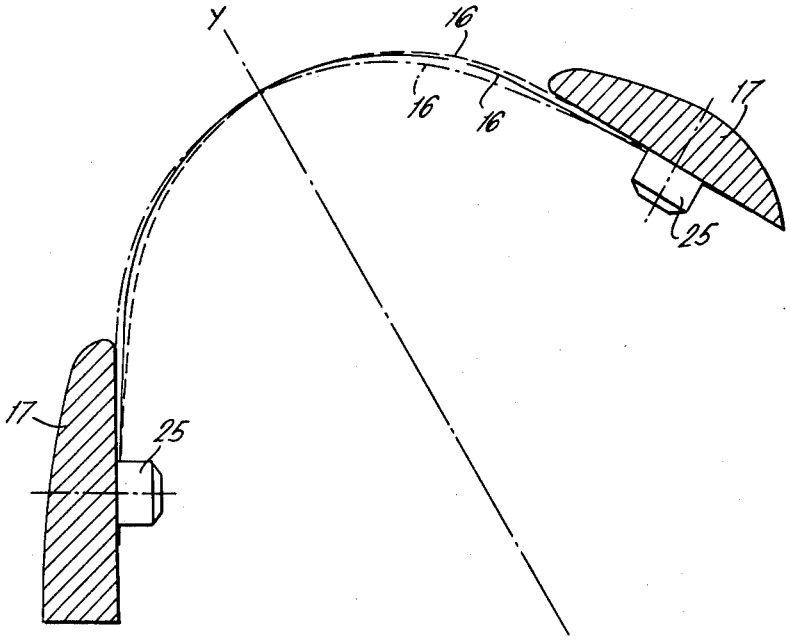
FIG. 8 illustrates the sympathetic flexing movement of a cutting foil of the two embodiments illustrated.

Referring to FIG. 1 there is shown an external view of an electric dry shaver, which may embody either the cutter and drive arrangement further described with reference to FIGS. 2 and 3, or that further described with reference to FIGS. 6 and 7. FIGS. 4, 5 and 8 are useful in explaining the operation of both the embodiments.

The shaver in FIG. 1 is in the form of a generally rectangular parallelepiped comprising front and back faces 10, 11, top and bottom end faces 12, 13, and opposite side faces 14, 15. A flexible part-cylindrical curved cutting foil 16 extends along the top end face 12 and is inclined towards the front face 10 for convenience in holding and manipulating the shaver during shaving. The foil 16 is carried by a cutting head 17 which is removable for cleaning purposes. The remainder of the visible exterior of the shaver comprises a sleeve housing 18 removable to give access to the interior.

A shaver ON/OFF electrical switch is provided on the front face 10, not shown. The rear face 11 is provided with a retractible spring-loaded trimmer 19*a*, shown in its retracted position, and a trimmer ON/OFF mechanical switch 19*b* operation of which to the "on" position serves mechanically to release the spring-loaded trimmer to move to its deployed position and simultaneously to couple a drive member to the trimmer.

The shaver includes a rotary electric drive motor 20 (FIG. 2) having its axis of rotation Z extending between said end faces 12, 13 generally midway between said front and back faces 10, 11 and generally midway between said side faces 14, 15. In one form, rechargeable batteries are accommodated one each side of the motor, and a printed circuit board is accommodated within the shaver adjacent the bottom end face 13.

Figure 2:
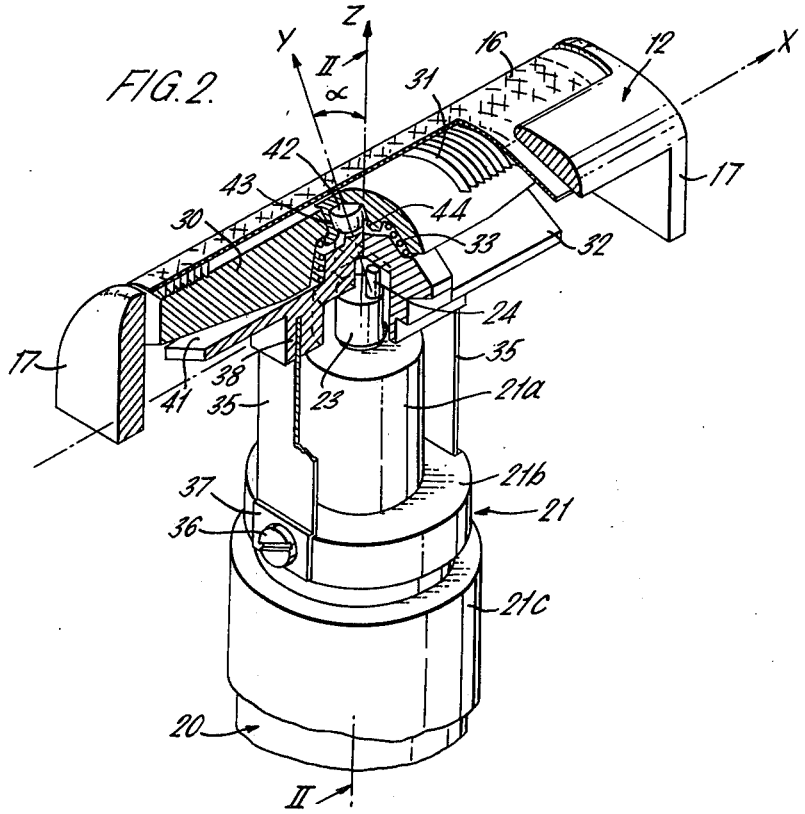
FIG. 2 is a perspective detail view, partly cutaway, of a cutter foil, cutter body, and drive means of a shaver according to one of the embodiments.
Figure 3:
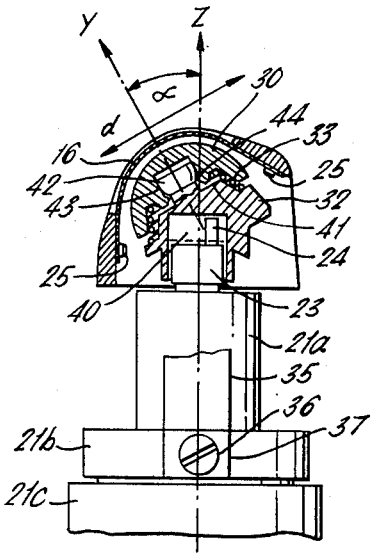
FIG. 3 is a sectional view on the line II—II in FIG. 2, perpendicular to the axis X and containing the axis Z.

Referring now to FIGS. 2 and 3, there is shown a portion of an internal stationary reference frame or body member 21 of the shaver. The member 21 is tubular and concentric with the motor axis Z, and has upper, central and lower portions 21*a*, 21*b* and 21*c*. The lower portion 21*c* receives and locates the stator of the electric motor 20. The electric motor 20 has an output drive shaft extending upwardly within the tubular member portions 21*b* and 21*a*, and has a protruding enlarged end portion 23. The end portion 23 carries an eccentric drive pin 24 which is driven around axis Z by rotation of the motor drive shaft and is further described below.

The foil 16 is supported in the cutting head 17 by pins 25 (FIG. 3) spaced along the opposite longitudinal edge portions of the foil 16, the opposite curved ends of the foil being unsupported.

A cutter body 30 is linearly reciprocable along an axis X and carries a plurality of spaced cutter blades 31 having curved cutting edges conforming to the curvature of the foil 16 and extending in planes perpendicular to the foil cylinder axis X. The cutter body 30 is carried and driven by a cutter support member 32. A frustoconical spring 33 acts between the support member 32 and the cutter body 30 to urge the edges of the cutter blades 31 into engagement with the foil 16.

The cutter support member 32 is mounted by a pair of spaced parallel leaf springs 35 secured at their lower ends to the central portion 21*b* of the frame member 21 by means of screws 36 and rectangular washers 37. The upper ends of the leaf springs 35 are securely seated in deep slots 38 in the cutter support member. The leaf springs 35 lie when unflexed in planes parallel to the axis Z and perpendicular to the axis X of linear reciprocation of the cutter body 30.

A drive slot 40 is formed in the underside of the cutter support member 32. The slot 40 extends parallel to and midway between the planes of the leaf springs 35, and extends perpendicular to the axis X. The above-described eccentric drive pin 24 works within the drive slot 40. The cutter support member has an upper surface 41 inclined towards the front face of the shaver as shown in FIG. 3. A part-spherical coupling head 42 rises centrally from the upper surface 41. The coupling head 42 works in a cylindrical bore 43 formed centrally of the length and width in the underside of the cutter body 30.

The bore 43 has an annular restriction 44 at its entrance such that the coupling head 42 has to be forced into the bore past the restriction. This traps the cutter body 30 to the cutter support member 32 against the separating action of the spring 33 when the cutting head 17 is removed for cleaning purposes. The bore 43 has an axis Y which is perpendicular to the reciprocation axis X and to the upper surface 41 of the cutter support member, and which is inclined at an acute angle $\alpha$ to the motor drive axis Z, as shown in FIG. 3. The angle $\alpha$ may be about 30°.

In operation the motor shaft end portion 23 rotates about its own axis Z. The eccentric drive pin 24 describes circles about axis Z, within the drive slot 40, to drive the cutter support member 32 in generally longitudinal oscillation constrained to a slightly curved path by flexing of the two leaf springs 35 toward and away from axis Z. The spring mounting has no play and is not subject to wear. The motion of the cutter support member is especially quiet with low friction losses.

The coupling formed by the part-spherical coupling head 42 and the bore 43 in turn converts the generally longitudinal oscillation of the member 32 into a primary linear oscillation of the cutter body 30 along axis X and a secondary mode of oscillation perpendicular to axis X and also perpendicular to axis Y, i.e., substantially in a plane parallel to the plane including the parallel opposite longitudinal edge portions of the foil 16. This motion is analyzed below. The foil is secured along its longitudinal edge portions by the pins 25 and is free at its curved ends. Consequently the foil is free to flex and so oscillates in sympathy with said secondary mode of oscillation of the cutter body 30.

Referring now to FIGS. 4 and 5, during operation of the shaver the leaf springs 35 flex between the limits indicated in broken lines in FIG. 4 with accompanying reciprocation of the support member 32 generally in the direction of axis X over a stroke of magnitude $c$. The primary reciprocation frequency $f$ is equal to the motor rotation speed. Due to the finite length $l$ of the leaf springs 35, the member 32 has an auxiliary minor amplitude oscillation in the direction of axis Z having a stroke $a$ which increases as $c$ increases and as the free length $l$ of the leaf spring 35 decreases. Thus the auxiliary oscillation can be written mathematically as $M_z = \phi(c,l)$, where $\phi(c,l)$ is a complex function. The frequency of the auxiliary oscillation is $F = 2f$, i.e., twice the frequency of linear reciprocation of the cutter body.

As shown in the vector diagram of FIG. 5, a displacement $a$ on the axis Z can be resolved into component $b = a \cos \alpha$, on the axis Y of the cutter bore 43, and a perpendicular component $d = a \sin \alpha$. The component $b$ is not transmitted to the cutter body 30 because the part-spherical coupling head 42 has freedom to move longitudinally within the bore 43 along axis Y. However the other component $d$ is transmitted to the cutter body 30 to drive the cutter body in the secondary mode of oscillation. In turn the cutter body 30 causes the foil 16 to oscillate in sympathy with the component $d$ at the frequency F.

In a typical construction, the following values may for example apply.

$c = 2.6$ mm.
$\alpha = 30°$
$f = 140$ Hz (8400 r.p.m.)
$l = 12.5$ mm

These values result in:

$a = 0.07$ mm.
$F = 280$ Hz
$d = 0.035$ mm.

Figure 6:
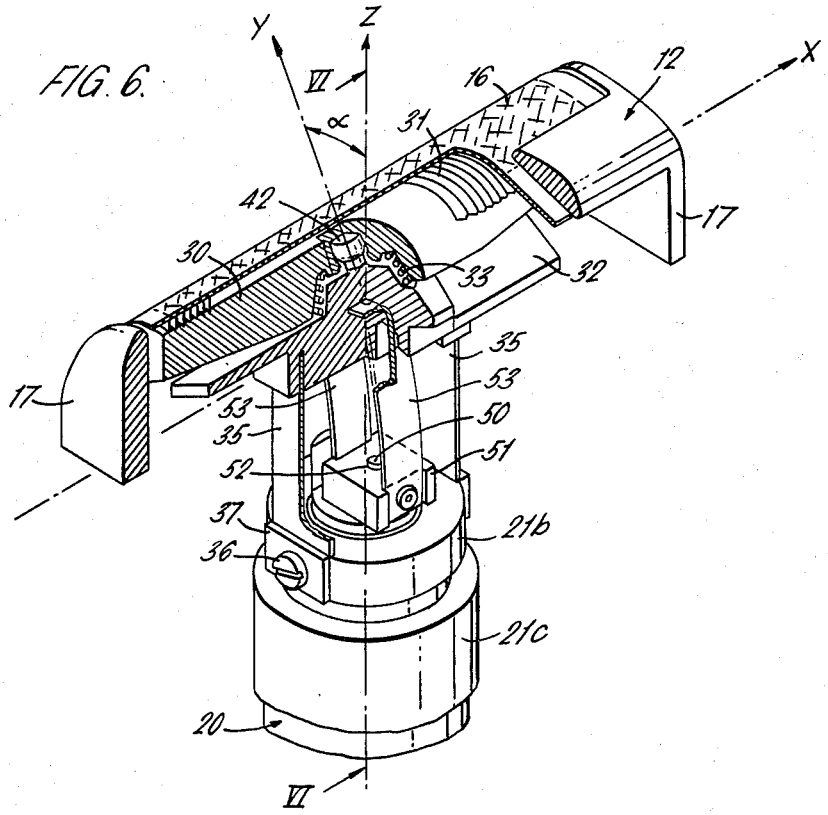
FIG. 6 is a view similar to FIG. 2 but illustrating the second embodiment which has an alternative drive arrangement.
Figure 7:
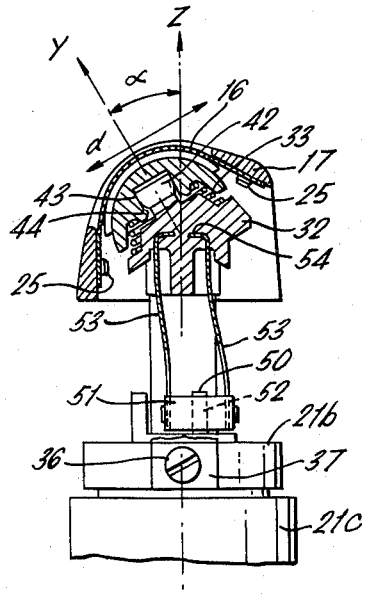
FIG. 7 is a sectional view on the line VI—VI in FIG. 6.

The embodiment illustrated in FIGS. 6 and 7 is similar to that of FIGS. 2 and 3 except for the drive transmission mechanism between the motor and the cutter support member 32.

The upper portion of 21*a* of the tubular member 21 is removed and the motor output drive shaft, on axis Z, is provided with an eccentric drive pin 50, driven like pin 24 in circles about axis Z, but not directly working in the cutter support member 32. Instead an intermediate drive block 51 is provided and pin 50 is rotatably received within a central bore 52 of the drive block 51. The block 51 thus also describes circles about axis Z. Two further spaced parallel leaf springs 53 are secured at their lower ends to opposite sides of the block 51 and at their upper ends 54 to shaped slots in the cutter support member 32. The springs 53 extend generally perpendicular to the leaf springs 35. The bodily circular movement of the block 51 is thereby converted into the generally longitudinal oscillation of the cutter support 32. This embodiment has the advantage that the block 16 is a close running fit on the eccentric pin 8 with a resultant reduction in noise, wear and power consumption.

In both embodiments the secondary mode of oscillation of the cutter and the foil in the direction of the axis *d*, which is at a frequency twice that of the linear reciprocation along the axis X, provides an improved shaving action. This is thought to be due mainly to the improved penetration of the short hairs being cut through the perforations in the foil 16 as a result of the secondary oscillation of the latter as driven by the cutter. There is also an improved sliding action of the foil over the skin and enhanced comfort. The amplitude of the secondary oscillation is preferably no more than five hundredths of a millimeter. The frequency of said secondary mode may be twice that of the primary mode, as described, but alternatively may be at another frequency, for example three or four times the primary frequency.

FIG. 8, which also relates to both embodiments, illustrates the range of the sympathetic flexing oscillation of the foil 16 as it is driven by the secondary mode of oscillation of the cutter body 30. As shown in this Figure the foil 16 is held by the pins 25 symmetrically with respect to the axis Y, the mean rest position of the foil 30 being shown as a full line. The limits of the flexing oscillation are shown respectively in broken lines, in one case by a simple discontinuous line and in the other case by a chain-dotted line. The nodes of the foil oscillation are thus at the longitudinal edge portions thereof.

I claim:

1. An electric dry shaver comprising a flexible part-cylindrical curved cutting foil; a cutter body having a plurality of cutter blades with cutting edges; means urging said cutter blade cutting edges into engagement with said foil; and driver means adapted to drive said cutter body both in a primary mode of oscillation along a linear path substantially parallel to said foil to effect a shaving action and in a secondary mode of oscillation along a linear path at an angle to said foil to cause said foil to oscillate in sympathy with said secondary mode of oscillation of said cutter body, the frequency of said secondary mode of oscillation being at least twice the frequency of said primary mode of oscillation.

2. A shaver as claimed in claim 1, wherein said cutter blade cutting edges are curved and said cutter blades extend in planes perpendicular to the foil cylinder axis, said primary mode of oscillation being substantially linear and axially of said foil.

3. A shaver as claimed in claim 2, wherein said foil has opposite longitudinal edge portions which are parallel to one another and lie in a plane, and wherein said secondary mode of oscillation is transverse to the foil cylinder axis and is substantially in a plane parallel to said plane including said parallel opposite longitudinal edge portions of the foil.

4. A shaver as claimed in claim 3, including means mounting said parallel longitudinal edge portions of the foil to a stationary shaver member, and said sympathetic oscillation of said foil is a flexing oscillation when viewed in end view with nodes at said longitudinal edge portions.

5. A shaver as claimed in claim 1, including a frustoconical spring, said spring acting on said cutter body towards said foil whereby to urge said cutter blade edges into engagement with said foil.

6. A shaver as claimed in claim 1, wherein the amplitude of said secondary oscillation is no greater than five hundredths of a millimeter.

7. An electric dry shaver comprising a flexible part-cylindrical curved cutting foil; a cutter body having a plurality of cutter blades with cutting edges; means urging said cutter blade cutting edges into engagement with said foil; drive means adapted to drive said cutter body both in a primary mode of oscillation parallel to said foil to effect a shaving action and in a secondary mode of oscillation at an angle to said foil to cause said foil to oscillate in sympathy with said secondary mode of oscillation of said cutter body; and a cutter support member, said cutter body being carried by said cutter support member; a pair of spaced parallel leaf springs, each of said leaf springs lying when unflexed in a plane perpendicular to said linear primary oscillation path, said leaf springs mounting said cutter support member to a shaver body portion; said cutter support member being driven by said drive means to oscillate with flexing of said leaf springs to provide first and second linear oscillation components of major and minor amplitude respectively perpendicular to and parallel to said leaf springs, said major amplitude component being transmitted directly to said cutter body to provide said primary linear oscillation of equivalent amplitude of said cutter body, said minor amplitude component serving to drive said cutter body in said secondary oscillation.

8. A shaver as claimed in claim 7, wherein said cutter body and said cutter support member are provided one each with a coupling head and a bore, said coupling head being received in said bore to permit limited freedom of movement of said cutter body relative to said support member in a direction perpendicular to said plane including the opposite longitudinal edge portions of said foil, whereby to substantially prevent transmission to said cutter body or said foil of any driven oscillation perpendicular to said last-mentioned plane.

9. A shaver as claimed in claim 8, wherein the axis of said bore extends at an acute angle to an axis extending parallel to the planes of said unflexed leaf springs.

10. An electric dry shaver in the form of a generally rectangular parallelepiped comprising front and back faces, opposite side faces, and opposite end faces; a flexible part-cylindrical curved cutting foil extending along one said end face of said parallelepiped and inclined towards said front face of said parallelepiped; a cutter body having a plurality of cutter blades, said cutter blades having curved cutting edges and extending in planes perpendicular to the foil cylinder axis; a spring acting on said cutter body to urge said cutting edges into engagement with said foil; drive means including a rotary electric drive motor, said drive motor having its axis of rotation extending between said opposite end faces generally midway between said front and back faces and generally midway between the opposite side faces of said parallelepiped; a cutter support member carrying said cutter body; a shaver body member; a pair of spaced parallel leaf springs mounting said cutter support member to said shaver body member, each said leaf spring lying when unflexed in a plane parallel to said opposite side faces, said electric motor having a rotary output member, said rotary output member adapted to drive said cutter support member in generally longitudinal oscillation with flexing of said leaf springs; and means coupling said cutter support member to said cutter body to drive said cutter body both in a primary mode of oscillation substantially linearly and axially of said foil to effect a shaving action and in a secondary mode of oscillation transverse to the foil cylinder axis and in a plane inclined towards said front face to cause said foil to oscillate in sympathy with said second mode of oscillation of said cutter body.

* * * * *